US005227611A

United States Patent [19]

Allatt et al.

[11] Patent Number: 5,227,611

[45] Date of Patent: Jul. 13, 1993

[54] BURNER MEANS MOUNTING ASSEMBLY

[76] Inventors: Robert G. Allatt, 4 - 315 George Street North, Riverwalk Estates, Cambridge, Ontario N1S 4X6, Canada; Gunter K. Richter, R.R. #1, Rockwood, Ontario, Canada, N0B 2K0

[21] Appl. No.: 842,680

[22] Filed: Feb. 27, 1992

[30] Foreign Application Priority Data

Feb. 27, 1991 [CA] Canada ..... 2037257

[51] Int. Cl.[5] ..... H05B 3/76

[52] U.S. Cl. ..... 219/458; 219/455

[58] Field of Search ..... 219/443, 445, 446, 447, 219/455, 456, 463, 466, 467, 458

[56] References Cited

U.S. PATENT DOCUMENTS

| | | | |
|---|---|---|---|
| 2,751,487 | 6/1956 | Vallorani | 219/463 |
| 2,877,334 | 3/1959 | McOrlly | 219/463 |
| 2,938,989 | 5/1960 | Smith | 219/463 |
| 3,016,445 | 1/1962 | Lien | 219/463 |
| 3,124,673 | 3/1964 | Yohe | 219/463 |
| 4,388,518 | 6/1983 | Willbanks | 219/455 |

*Primary Examiner*—Teresa J. Walberg

*Attorney, Agent, or Firm*—Jeffrey T. Imai; Arne I. Fors; D. Doak Horne

[57] ABSTRACT

A mounting assembly is used in mounting a supporting element to support a burner. The mounting assembly includes at least two arms to engage the leg portions of a burner and further provides an upwardly extending leg for connection with the supporting element. The mounting assembly when connected to the supporting element provides a cantilevered support relative to the plane of the burner, which provides enhanced stability for the burner.

9 Claims, 2 Drawing Sheets

BURNER MEANS MOUNTING ASSEMBLY

BACKGROUND OF THE INVENTION

1. Field of the Invention

The present invention relates to burner assemblies and, more particularly, it relates to a mounting means for securing a burner to a support means.

2. Description of the Related Art

The burner assemblies known in the art, conventionally employ a burner support, more commonly known as a spider support, which is connected to a mounting element facilitating the mounting of the support to the burner.

Various advancements and improvements have evolved in the art, typical of which is U.S. Pat. No. 2,938,939.

Smith, in U.S. Pat. No. 2,939,939 discloses a heater unit assembly which provides a burner support including a central ring with support arms radiating therefrom. The arms include projections to stabilize the burner on the support and further an extension arm connected to the central ring extends downwardly to a burner post mounting.

Although this arrangement has some degree of usefulness, it is limited since it incorporates a plurality of components susceptible to thermal fatigue and further, since it requires projections on the burner support to enhance stability.

Willbanks et al., in U.S. Pat. No. 4,388,518, disclose a mounting bracket for mounting a spider support to a burner assembly. The bracket includes a sleeve journaled about a portion of the burner leg which is, connected to a support arm via an intermediate member extending therebetween. The support arm provides an abutment member for contact with a vertical portion of the outside leg. In addition, a separate and detached member is associated with the legs of the burner to prevent lateral displacement of the legs relative to each of the same.

As is clearly evident from the teachings of Willbanks et al., an unnecessarily complicated arrangement which relies on a plurality of components is required to achieve sufficient stability and support for a burner.

SUMMARY OF THE INVENTION

In view of the limitations delineated in the above, there exists a need for a burner mounting assembly is simple in design and further, which employs a minimal number of components for the least possible contact with the burner without sacrificing any stability therefor.

Applicant, with the present invention, accommodates this need by providing a novel and highly effective burner support.

According to one aspect of the present invention, there is provided a burner assembly comprising:

burner means having terminal end portions;

support means underlying and supporting the burner means and including at least one diametrically extending arm;

mounting means for mounting the support means to the burner means, the mounting means including a mounting member connected adjacent the end portions of the burner means, the mounting member being operatively associated with the diametrically extending arm of the support means whereby the arm is inclined relative to a plane of the burner means to cantilever the burner means.

The burner means comprises a continuous loop burner, well known in the art, having terminal end portions for connection to the power supply of an electrical cooking stove.

Support means for supporting the burner means, more commonly referred to as a spider support, underlies the burner means for supporting the same. Such supports generally include a plurality of laterally extending arms.

For purposes of the present invention, any known arrangement which includes a diametrically extending support arm may be employed for the supporting means.

According to a further aspect of the present invention, there is provided a burner assembly having burner means including terminal end portions and support means for supporting the burner means, the improvement wherein:

the mounting means includes connecting means having at least two arms for connecting the terminal end portions of the burner means, the connecting means including an integral leg member extending upwardly from one of the arms of the connecting means.

The mounting means, in accordance with the present invention, connects the end portions of the burner means in a spaced apart relationship and in a manner such that they are disposed in vertically spaced apart planes.

The mounting means may be fabricated from materials known in the art suitable for repeated thermal expansion and contraction e.g. stainless steel.

Applicant has found that undesirable noise due to vibration of the mounting means can be substantially eliminated by fabricating the mounting means from a similar material used for the manufacturing of burner means and having a similar coefficient of thermal expansion.

The connecting means of the mounting means includes a single retaining arm for retaining on the support means to in the art as the outer terminal leg and, a dual retaining arm for retaining the inner terminal leg.

The mounting means provides a leg extending upwardly from one arm of the connecting means for connection with a diametrically extending support arm.

The connection between the mounting means and support arm may be achieved by suitable methods e.g. welding, bolting, etc.

The inner and outer legs are preferably retained by the connecting means such that they are in a vertically spaced apart relationship.

BRIEF DESCRIPTION OF THE DRAWING

The arrangement, when mounted to a support member as previously described herein, cantilevers the support means for enhanced stability of the burner means positioned thereover.

Having thus generally described the invention, reference will now be made to the accompanying drawings, illustrated preferred embodiment and in which.

DESCRIPTION OF THE PREFERRED EMBODIMENTS

Figure 1:
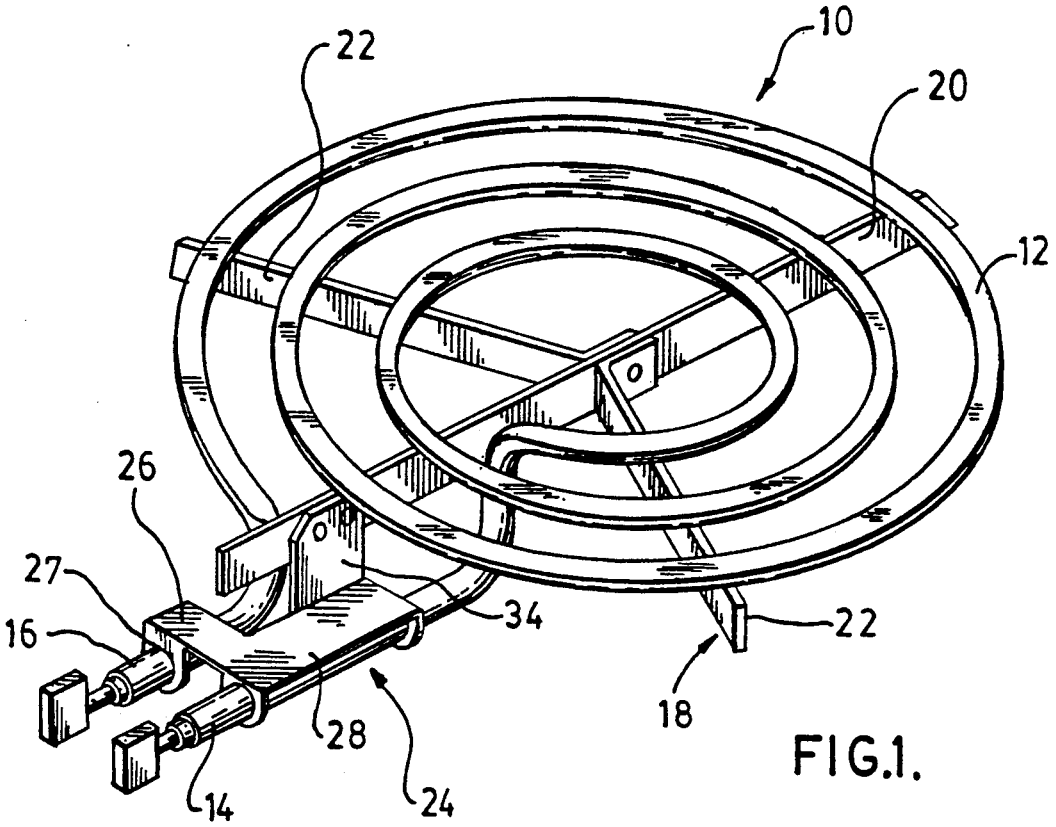
FIG. 1 is a perspective view of a burner assembly illustrating the mounting means of the present invention.

Referring to the drawings, shown in FIG. 1 is a burner assembly, generally indicated by numeral 10. As continuous loop burner 12 having terminal leg portions, namely, inner leg 14 and outer leg 16, overlies support means 18 which includes at least one diametrically extending support 20 with auxiliary supports 22 radiating therefrom.

Any suitable support means which includes a diametrically extending support may be used with the present invention.

The mounting means, according to the present invention and generally represented by 24, comprises a unitary bracket for mounting the support means 18 to the burner means 12.

The mounting means 24 may be fabricated from a planar portion of a suitable material e.g. steel and subsequently formed into the desired shape using known machining methods.

Figure 2:
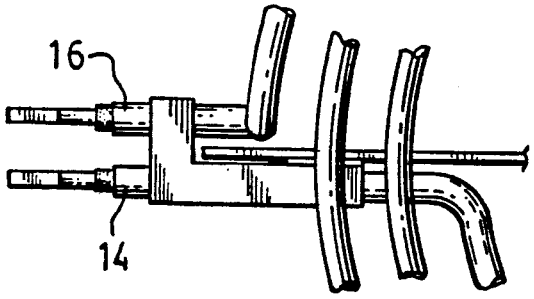
FIG. 2 is an enlarged top plan view of the mounting means of the present invention.
Figure 3:
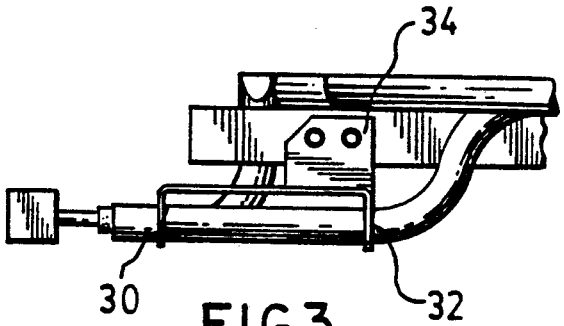
FIG. 3 is a side view of FIG. 2.

The mounting means 24 includes connecting means, shown more clearly in FIGS. 2 and 3 which connects legs 14 and 16 in a spaced apart relationship. The connecting means includes a retaining arm 26 having a downwardly extending clasping segment 27 for single point attachment to the outer leg 16 and, unitary therewith, a second retaining arm 28 including downwardly extending and horizontally spaced apart clasping segments 30 and 32 for dual point attachment to inner leg 14.

The arrangement, when viewed in plan (FIG. 2), provides an L-shaped structure.

The second retaining arm 28 and, more specifically, the downwardly extending clasping segment 32 preferably extends downwardly in length to a greater degree than clasping segment 30. In this arrangement, the legs 14 and 16 are disposed in vertically spaced apart planes, with the intermost end of inner leg 14 being vertically offset relative to outer leg 16, as is illustrated in FIG. 4.

Figure 4:
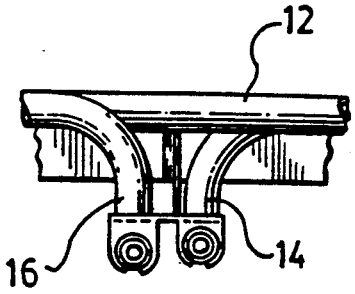
FIG. 4 is an end view of FIG. 3.
Figure 5:
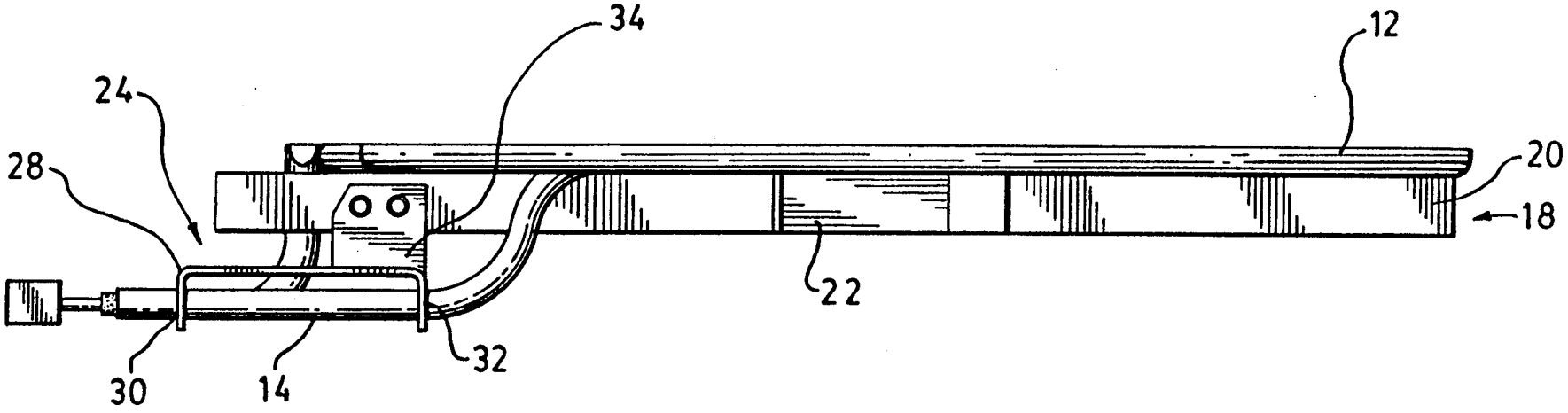
FIG. 5 is side elevational view of FIG. 3.

Extending upwardly and substantially normally from a top surface of the second retaining arm 28, there is preferably integrally included a leg member 34, shown in FIGS. 1, 3 and 4, which is connected to an end portion of support arm 20, perpendicularly oriented thereto, by suitable means e.g. welding.

Applicant, has found that the mounting means 24 of the present invention, when connected to the diametrically extending support arm 20 underlying burner means 12, produces a cantilever arrangement where the forward end of burner means 12 is urged onto the support means 18.

This arrangement provides for firm support of the burner means 12, while minimizing contact or securement with the support means 18.

Further, since the burner means 12 is firmly supported, the common problem inherent with known arrangements e.g. the mounting means loosening and hence causing vibration of the support means, is obviated.

As those skilled in the art will realize, these preferred illustrated details can be subjected to substantial variation, without affecting the function of the illustrated embodiments. Although embodiments of the invention have been described above, it is not limited thereto and it will be apparent to those skilled in the art that numerous modification form part of the present invention insofar as they do not depart from the spirit, nature and scope of the claimed and described invention.

The embodiments of the present invention in which an exclusive property or privilege is claimed are defined as follows:

1. A burner assembly comprising:

burner means comprising a continuous convoluted burner portion having inner and outer convolutions and having offset first and second terminal leg portions extending from the inner and outer convolutions respectively;

support means including at least three arms defining an underlying support for said continuous convoluted burner portion;

a mounting member extending from one of said arms, said mounting member having a first retaining arm for single point attachment to said first leg portion and a second retaining arm for single point attachment to said second leg portion cantilevering said second leg with respect to said first leg portion thereby urging said continuous convoluted burner portion onto said support means.

2. The burner assembly as claimed in claim 1 wherein said single point attachment is at a first perpendicular distance with respect to the support arm and said dual point attachments are in an offset relation to said single point attachment.

3. The burner assembly as defined in claim 2 wherein said mounting means is unitary.

4. The burner assembly as defined in claim 2 wherein said mounting member includes at least a pair of arms.

5. The burner assembly as defined in claim 4, wherein said mounting member includes an upwardly extending leg member.

6. The burner assembly as defined in claim 5, wherein said leg member extends upwardly from one of said arms.

7. In a burner assembly having burner means comprising a continuous convoluted burner portion having inner and outer convolutions and having offset first and second terminal leg portions extending from the inner and outer convolutions;

support means including at least three arms defining an underlying support for said continuous convoluted burner portion;

a mounting member extending from one of said arms; the improvement wherein said mounting member includes a first retaining arm for single point attachment to said first leg portion and a second retaining arms for dual point attachments to said second leg portion cantilevering said second leg with respect to said first leg portion thereby urging said continuous convoluted portion onto said support means.

8. The mounting means as defined in claim 7, wherein said mounting means in unitary.

9. The mounting means as defined in claim 7, said mounting means is integral with said connecting means.

* * * * *